United States Patent [19]

Hurtig

[11] 4,333,366

[45] Jun. 8, 1982

[54] CRESCENT WRENCH OPERATING INDICATOR

[75] Inventor: Carl R. Hurtig, Cohasset, Mass.

[73] Assignee: Encor Limited, Cohasset, Mass.

[21] Appl. No.: 132,616

[22] Filed: Mar. 21, 1980

[51] Int. Cl.[3] ..... B25B 13/16

[52] U.S. Cl. ..... 81/170; 81/DIG. 5

[58] Field of Search ..... 81/165, 170, DIG. 5

[56] References Cited

U.S. PATENT DOCUMENTS 991,925 5/1911 Wright ..... 81/DIG. 5

1,748,218 2/1930 Groves ..... 81/DIG. 5

2,722,150 11/1955 Green ..... 81/165

2,955,498 10/1960 Engstrand ..... 81/165

*Primary Examiner*—James G. Smith

*Attorney, Agent, or Firm*—Weingarten, Schurgin & Gagnebin

[57] ABSTRACT

An adjustable flat wrench such as a Crescent wrench having tactile indicating surfaces adjacent the adjustment screw to denote to a user the direction of adjustment screw rotation for closing or opening of the wrench jaws.

4 Claims, 2 Drawing Figures

CRESCENT WRENCH OPERATING INDICATOR

FIELD OF THE INVENTION

This invention relates to adjustable wrenches and more particularly to adjustable flat wrenches in which the jaws are movable by rotation of an adjustment screw.

BACKGROUND OF THE INVENTION

Adjustable flat wrenches, such as Crescent wrenches, are well known and comprise a pair of jaws which are opened and closed in response to rotation of an adjustment screw rotatably disposed in the wrench body and usually operable by a user's thumb. A given direction of rotation of the adjustment screw will cause opening of the wrench jaws when the wrench is in one operating position, and will cause closure of the wrench jaws when the wrench is in the opposite operating position. Although the movement of the jaws in response to a given adjustment screw rotation can be remembered or learned for each wrench position, usually a user will rotate the adjustment screw in one direction and reverse the direction of the jaws are not moving in the intended manner.

SUMMARY OF THE INVENTION

In accordance with the present invention, an adjustable flat wrench is provided in which tactile indicator surfaces are provided adjacent the adjustment screw on both sides of the wrench, the surfaces being tactually distinguishable by a user to immediately denote the direction of screw rotation required for jaw opening or closing. The indicator surfaces typically include a relatively rough surface on one side of the adjustment screw and a relatively smooth surface on the opposite side of the adjustment screw. Sequential sensing of the two indicator surfaces by the user's thumb indicates the direction of adjustment screw rotation or movement for an intended jaw movement. For example, the rough-to-smooth direction can indicate the direction for tightening of the jaws, while the smooth-to-rough direction can indicate jaw opening. The direction for a given jaw movement is opposite for the two wrench positions. Thus, the rough and smooth surface indicators are oppositely arranged on the respective sides of the wrench.

DESCRIPTION OF THE DRAWINGS

The invention will be more fully understood from the following detailed description taken in conjunction with the accompanying drawings, in which.

DETAILED DESCRIPTION OF THE INVENTION

Figure 1:
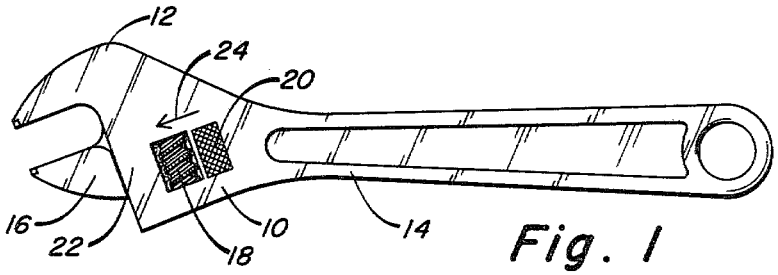
FIG. 1 is a plan view of one side of an adjustable flat wrench incorporating the adjustment indicators according to the invention.

Referring to FIG. 1, there is shown an adjustable flat wrench of the type which is known as a Crescent wrench and which includes a wrench body 10 having a fixed jaw 12, an angularly disposed handle 14, and a movable jaw 16 which is coupled to and movable in response to rotation of an adjustment screw 18. A knurled area 20 is provided on the right side of screw 18, while the left side of the screw 18 is an area of the relatively smooth surface of the wrench body. The surfaces 20 and 22 are tactually distinguishable and can be sensed by rubbing the user's thumb over these respective areas. In the illustrated embodiment, the rough-to-smooth direction noted by arrow 24 indicates that rotation of screw 18 in this direction will cause tightening or closure of jaws 12 and 16. Conversely, the opposite smooth-to-rough direction denotes that corresponding rotation of screw 18 will cause loosening or opening of the jaws.

Figure 2:
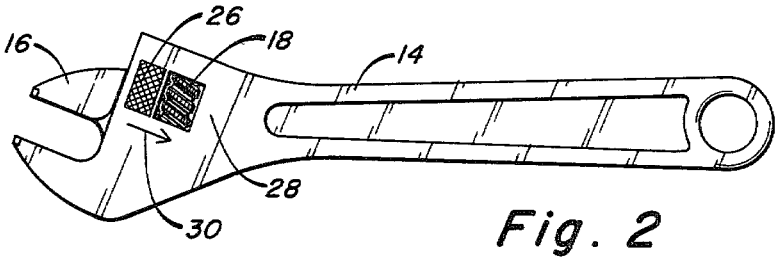
FIG. 2 is a plan view of the opposite side of the wrench of FIG. 1 illustrating the adjustment indicators.

The opposite side of the wrench is depicted in FIG. 2 and includes a knurled surface 26 on the left side of screw 18 and a smooth surface 28 on the right side of screw 18. It is evident that the relatively rough and smooth indicator areas are oppositely arranged on the respective sides of the wrench. In employing the wrench in the position illustrated in FIG. 2, the rough-to-smooth direction denoted by arrow 30 indicates that the corresponding rotation of screw 18 in the direction of arrow 30 will cause closure of the jaws. The smooth-to-rough direction opposite to the direction of arrow 30 indicates that such rotation of screw 18 will cause opening of the jaws. Thus, for either wrench position the rough-to-smooth direction denotes jaw closure, while the smooth-to-rough direction denotes jaw opening. The indicator areas are readily detected by rubbing contact of these areas by the thumb of a user as the wrench is gripped in a user's hand. In operation, a user can readily identify the tactually distinguishable areas on the side of the wrench which confronts the user's thumb to immediately denote the direction in which the adjustment screw is to be moved for intended jaw opening or closing.

It will be appreciated that the tactually distinguishable areas can be provided in various ways. For example, the relatively rough surface area can be provided by knurling, sandblasting, grooving, and the like. The relatively smooth area typically is the usual metal finish of the wrench, although this area can be polished or otherwise finished to provide an intended smooth feel in relation to the rough feel of the opposite area. Or the tactile distinction can be provided by areas distinguishable to the touch other than by surface roughness. A visual indication of jaw movement as by arrows embossed or imprinted on the wrench body may also be provided if desired. It is also contemplated that the invention can be embodied in adjustable wrenches of various configurations other than that paticularly illustrated herein. Accordingly, the invention is not to be limited except as indicated in the appended claims.

What is claimed is:

1. In an adjustable wrench including a body, a handle, and a pair of jaws, at least one of which is movable toward and away from the other jaw, and a rotatable adjustment screw manually operable to cause jaw opening and closing, the improvement comprising:

a first tactual relatively roughened surface area disposed on at least one side of the wrench body closely adjacent one radial edge of said adjustment screw;

a second tactual relatively smooth surface area, tactually distinguishable from the first surface area, and being disposed on at least said one side of the wrench body closely adjacent another radial edge of said adjustment screw opposite said one radial edge; and the rough to smooth surface area transition direction across the adjustment screw indicating the direction of rotation of the adjustment screw to cause intended jaw movement in one direction.

2. The adjustable wrench of claim 1 wherein the wrench can be used in either of two operating positions and wherein each side of the wrench body includes relatively roughened and relatively smooth tactually sensible surface areas which are tactually distinguishable from each other.

3. The adjustable wrench of claim 2 wherein the rough to smooth surface area transition is adapted to be sensed by the thumb of a user while holding the wrench.

4. The adjustable wrench of claim 3 wherein the adjustment screw has a sense of rotation with the wrench in one operating position opposite to the sense of rotation for the second operating position for a given jaw movement; and wherein the relatively roughened and relatively smooth surface areas on one side of the wrench are in opposite disposition to the relatively roughened and relatively smooth surface areas on the opposite side of the wrench.

* * * * *

UNITED STATES PATENT AND TRADEMARK OFFICE

CERTIFICATE OF CORRECTION

PATENT NO. : 4,333,366

DATED : June 8, 1982

INVENTOR(S) : Carl R. Hurtig

It is certified that error appears in the above-identified patent and that said Letters Patent are hereby corrected as shown below:

In the Title:

Please delete "CRESCENT" and insert --ADJUSTABLE-- so that the title now reads

ADJUSTABLE WRENCH OPERATING INDICATOR

Signed and Sealed this

*Twenty-fifth* Day of *January 1983*

[SEAL]

*Attest:*

GERALD J. MOSSINGHOFF

*Attesting Officer*

*Commissioner of Patents and Trademarks*